US007661230B2

(12) United States Patent
Peaco

(10) Patent No.: US 7,661,230 B2
(45) Date of Patent: Feb. 16, 2010

(54) METHOD FOR CONSTRUCTING LOG STRUCTURE HAVING LOG MEMBERS WITH NOTCHES FILLED WITH PLUGS

(76) Inventor: Lawrence Peaco, 247 Durham Rd., New Gloucester, ME (US) 04260

( * ) Notice: Subject to any disclaimer, the term of this patent is extended or adjusted under 35 U.S.C. 154(b) by 552 days.

(21) Appl. No.: 11/287,998

(22) Filed: Nov. 28, 2005

(65) Prior Publication Data

US 2007/0137122 A1 Jun. 21, 2007

(51) Int. Cl.
*E04B 1/10* (2006.01)
*E04G 21/14* (2006.01)
*B27M 3/00* (2006.01)

(52) U.S. Cl. ..... 52/233; 52/745.1; 52/745.2; 144/359

(58) Field of Classification Search ..... 52/233, 52/747.1, 592.6, 730.7, 589.1, 745.09, 745.1, 52/745.13, 745.2; 144/359
See application file for complete search history.

(56) References Cited

U.S. PATENT DOCUMENTS

| | | | | | |
|---|---|---|---|---|---|
| 2,416,162 | A * | 2/1947 | Drake | 52/233 |
| 4,279,108 | A * | 7/1981 | Collister, Jr. | 52/233 |
| 4,312,161 | A | 1/1982 | Goldade | |
| 4,356,676 | A * | 11/1982 | Hauptman | 52/396.04 |
| 4,392,520 | A | 7/1983 | Wrightman | |
| 4,463,532 | A | 8/1984 | Faw | |
| 4,510,724 | A | 4/1985 | Magnuson | |
| 4,742,657 | A | 5/1988 | Veech | |
| 4,901,489 | A * | 2/1990 | Garber | 52/233 |
| 5,608,997 | A * | 3/1997 | Mahowich | 52/233 |
| 5,799,452 | A * | 9/1998 | Moore | 52/233 |
| 6,023,895 | A * | 2/2000 | Anderson | 52/233 |
| 6,059,630 | A * | 5/2000 | Paxton et al. | 446/106 |
| 6,070,376 | A | 6/2000 | Asper | |
| 6,283,668 | B1 * | 9/2001 | Norek | 403/231 |
| 6,385,929 | B1 * | 5/2002 | Englehart | 52/233 |
| 6,418,680 | B1 * | 7/2002 | Calkins | 52/233 |
| 6,543,193 | B2 | 4/2003 | Houseal | |
| 6,564,526 | B2 * | 5/2003 | Chambers | 52/747.1 |
| 6,729,084 | B2 | 5/2004 | Neal | |
| 6,786,015 | B2 | 9/2004 | Wilt | |
| 6,851,233 | B2 | 2/2005 | Morgenstern | |
| 6,904,728 | B2 | 6/2005 | Stutts | |
| 6,931,803 | B1 | 8/2005 | Davis et al. | |
| 6,951,079 | B2 | 10/2005 | Weiss | |
| 2002/0121055 | A1 * | 9/2002 | Englehart | 52/233 |

* cited by examiner

*Primary Examiner*—Gay Ann Spahn
*Assistant Examiner*—Joshua Ihezie
(74) *Attorney, Agent, or Firm*—Anthony D. Pellegrini, Esq.

(57) ABSTRACT

An improved structure, whereby the log structure is comprised of at least two adjacent walls mated to form a corner, with each wall constructed of logs laid horizontally upon each other, the logs alternating between protruding and nonprotruding logs, such that the ends of the protruding logs of the walls are interleaved, with the ends of the protruding logs of the first wall having notches cut from them to facilitate the mating of the first and second walls, and further comprising plugs to be inserted into the notches upon completion of assembly of the log structure, and a method for constructing same.

8 Claims, 5 Drawing Sheets

METHOD FOR CONSTRUCTING LOG STRUCTURE HAVING LOG MEMBERS WITH NOTCHES FILLED WITH PLUGS

BACKGROUND OF THE INVENTION

1. Technical Field

The invention relates generally to the field of log structures. More specifically, the invention is directed to an improved corner assembly of a log structure and a method for constructing same.

2. Description of Prior Art

Log structures are well-known in the art. These include log cabins, log outbuildings, and other structures where the exterior walls are primarily constructed of logs. Walls for log structures erected by known construction methods are typically constructed at the building site, one log placed upon another one at a time. This method is required in order to connect the ends of logs forming two adjacent walls, whereby such logs must overlap each others' ends to form a structurally sound corner between the two walls. This method is time consuming and weather dependent, and involves a great deal of manual labor. It does not lend itself to the prefabrication of walls for log structures. However, prefabrication of walls in general allows for much greater construction efficiencies, because the walls may be erected within an enclosed environment, without regard to weather conditions at the building site. There are also efficiencies of scale achieved with prefabrication. Final assembly of a structure at the building site is much faster if the walls are prefabricated, and final assembly is more readily performed with the assistance of machinery, such as cranes, thereby reducing labor expense and the total time required.

Construction methods involving prefabricating wall panels at a remote location and then installing the panels at the work site are well known in the art. See, e.g., Weiss, U.S. Pat. No. 6,951,079 (Oct. 4, 2005), "System and Method of Panelized Construction". However, none of these methods have been adapted for the walls comprising log structures such that the individual walls can be easily erected and mated together, then made secure.

The prior art discloses various methods for mating adjacent walls of log structures. Traditional methods include using logs with notches cut into their surfaces near the log ends, such that the end of a log of one wall will snugly fit into the notch of an adjacent log of the second wall. See Garber, U.S. Pat. No. 4,901,489 (Feb. 20, 1990), "Log for Constructing Log Structures and Associated Log Fabricating Process"; Paxton, et al., U.S. Pat. No. 6,059,630 (May 9, 2000), "Log Based Assembly Kit"; Chambers, U.S. Pat. No. 6,564,526 (May 20, 2003), "Accelerated Log Building Method"; Morgenstern, U.S. Pat. No. 6,851,233 (Feb. 8, 2005), "Cast Log Structure". These construction methods, however, require each log to be placed one at a time to fit the notch of the underlying log. This does not lend itself to rapid construction.

Still other methods are known in the art wherein the ends of the logs themselves are notched, tongue-in-groove style. See Wrightman, U.S. Pat. No. 4,392,520 (Jul. 12, 1983), "Log Building Construction"; Magnuson, U.S. Pat. No. 4,510,724 (Apr. 16, 1985), "Building Structure"; Moore, U.S. Pat. No. 5,799,452 (Sep. 1, 1998), "Log Construction"; Davis, et al., U.S. Pat. No. 6,931,803 (Aug. 23, 2005), "Modular Building System". In each of these construction methods, however, the corners are mated together snugly, so individual logs must still be placed one at a time or the adjacent walls cannot be mated.

Construction methods using alternating protruding logs are also known in the art. See Faw, U.S. Pat. No. 4,463,532 (Aug. 7, 1984), "Prefabricated Wall Unit for Log Building Construction, Method of Producing Same and Method of Constructing Log Building Therewith"; Calkins, U.S. Pat. No. 6,418,680 (Jul. 16, 2002), "Log Panel System with Panels Comprising a Plurality of Stacked Logs and an End Board Fixedly Attached to the Ends of Each Panel". In this construction method, the alternating logs and the spaces between them serve the function of the notched out tongue-in-groove design described above. But as with the previously described methods, the mating log ends are very snug when the wall is completed, again requiring log by log construction.

Thus none of the disclosed prior art anticipates the present invention.

The present invention seeks to alleviate the aforesaid problems, by providing a method of construction whereby adjacent walls having alternating protruding log ends can be easily mated at the corners during erection of the walls, thus lending itself to the use of prefabricated walls for log structures. As such, full walls may be built in a weather-independent environment, such as an enclosed assembly plant, and then moved to the building site, ready to be erected. This creates a savings in time and money, because of the efficiencies of prefabrication at a single location and the independence from weather conditions. Erection time of a log structure at the building site when prefabricated log walls are used is a matter of hours, rather than days or weeks under old log-on-log methods. Multiple homes can be constructed at once in the assembly plant, further increasing efficiencies.

It is therefore an objective of the present invention to provide a useful, improved log structure that can be prefabricated in a remote location away from the building site.

It is further objective of the present invention to provide a useful, improved log structure that can be prefabricated in a weather-independent environment.

It is further objective of the present invention to provide a useful, improved log structure that consists of prefabricated walls which can be transported fully assembled to the building site.

It is further objective of the present invention to provide a useful, improved log structure that can be quickly erected using mechanical means to lift and position fully assembled walls, such as cranes.

It is further objective of the invention to provide a method for erecting useful, improved log structures utilizing prefabricated walls.

Other objectives of the present invention will be readily apparent from the description that follows.

SUMMARY OF THE INVENTION

The present invention is an improved log structure and method for constructing same. The log structure is comprised of at least two adjacent walls mated together to form a corner. Each wall is constructed of logs laid horizontally upon each other. The logs alternate between protruding and nonprotruding logs, where the protruding log ends extend laterally beyond the ends of the nonprotruding logs. The ends of the protruding logs are aligned with each other to a substantially uniform degree, and the ends of the nonprotruding logs are aligned with each other to a substantially uniform degree. The protruding log ends extend beyond the ends of the nonprotruding logs at least a distance greater than the diameter of the protruding logs. The protruding logs of one wall are aligned with the nonprotruding logs of the adjacent wall.

The corner assembly is formed by the interleaving of alternating protruding log ends extending beyond the side edge of each adjacent wall. Each protruding log end fits into the space created between two protruding log ends of the adjacent wall. Because the logs comprising the walls are substantially identical in dimension, the space between any two protruding log ends is substantially identical to the diameter of the protruding log end to be fit therebetween. As such, two fully assembled adjacent walls cannot be mated together because of the resulting high degree of friction between the interleaved protruding log ends. The only way to construct the log structure having this corner assembly design, therefore, is to alternate the laying of logs from the two adjacent walls. The resulting corner assembly will have a tight and secure fit, but the assembly is log on log at the building site.

The present invention solves the above-described problem by incorporating a removable element, known as a plug, into the protruding end of each of the logs in at least one of the walls. The plug fits into a notch formed into the protruding end of each of the logs. The notches may be cut from the top portions of the protruding log ends or the bottom portions of the protruding log ends, as desired. When the plug is removed from the log ends, the spaces between each pair of protruding log ends becomes greater than the diameter of the adjacent protruding log end to be fit in between. This increased space eliminates any frictional forces between the two adjacent walls during assembly. As a result, two fully and independently assembled walls may be brought together easily and the protruding log ends interleaved to form a corner assembly. Once the adjacent walls are placed in their desired positions and secured to each other, the plugs are replaced, achieving the same snug fit as would have resulted if the walls were erected using a log on log construction method. While there is some friction involved in reinserting the plugs, this can be dealt with much easier than attempting to mate an entire wall to another. Moreover, given the slight degree of inherent play in the protruding ends of the logs, there will be only a single plug which will experience the full degree of frictional forces when being reinserted, namely the final plug to be inserted.

The method of the present invention comprises the steps of preparing the logs for each wall at a remote location, such as at an assembly building; assembling each wall in its entirety without the plugs, independently from the adjacent wall; then transporting the two fully assembled walls to the building site and positioning them as desired. Machinery, such as cranes, can be used to assist with the positioning of the walls. Once the walls are positioned correctly and secured to each other, the plugs are reinserted, completing the corner assembly. The plugs can optionally be secured within the log ends by mechanical fasteners or adhesives.

While the plugs can be formed of the portions of the protruding log ends removed to make the notches, plugs made from other materials may also be used, provided they fit snugly within the notches once the two walls are properly mated. Moreover, if the plugs are all cut from the log ends to a substantially uniform shape and dimension, a plug cut from one log end may be reinserted into the notch of a different log end. This adds to the ease of construction because individual plugs need not be associated with any particular notch.

When four walls are to be used, for example, as a log cabin, only two opposing walls need have their protruding ends notched for removable plugs. The two adjacent walls can be constructed with unnotched log ends. However, the protruding ends of all four walls may be notched, if desired. This would create an even greater space between any pair of protruding log ends, though twice as many plugs would have to be replaced. Where more than four walls are used, any number of those walls may have their protruding log ends notched, as long as at least one side of a wall of every pair of walls is notched. Similarly, a fully assembled wall may have the protruding log ends notched only on one side; if this arrangement is used, then the wall adjacent to the unnotched side of the wall must in turn have its protruding log ends notched.

The use of plugs in the ends of the protruding logs is novel and not anticipated by the prior art. Moreover, the ability to prefabricate entire walls for log structures and then to erect them an entire wall at a time at the building site is not anticipated by the prior art.

Other features and advantages of the invention are described below

DETAILED DESCRIPTION OF THE INVENTION

Figure 1:
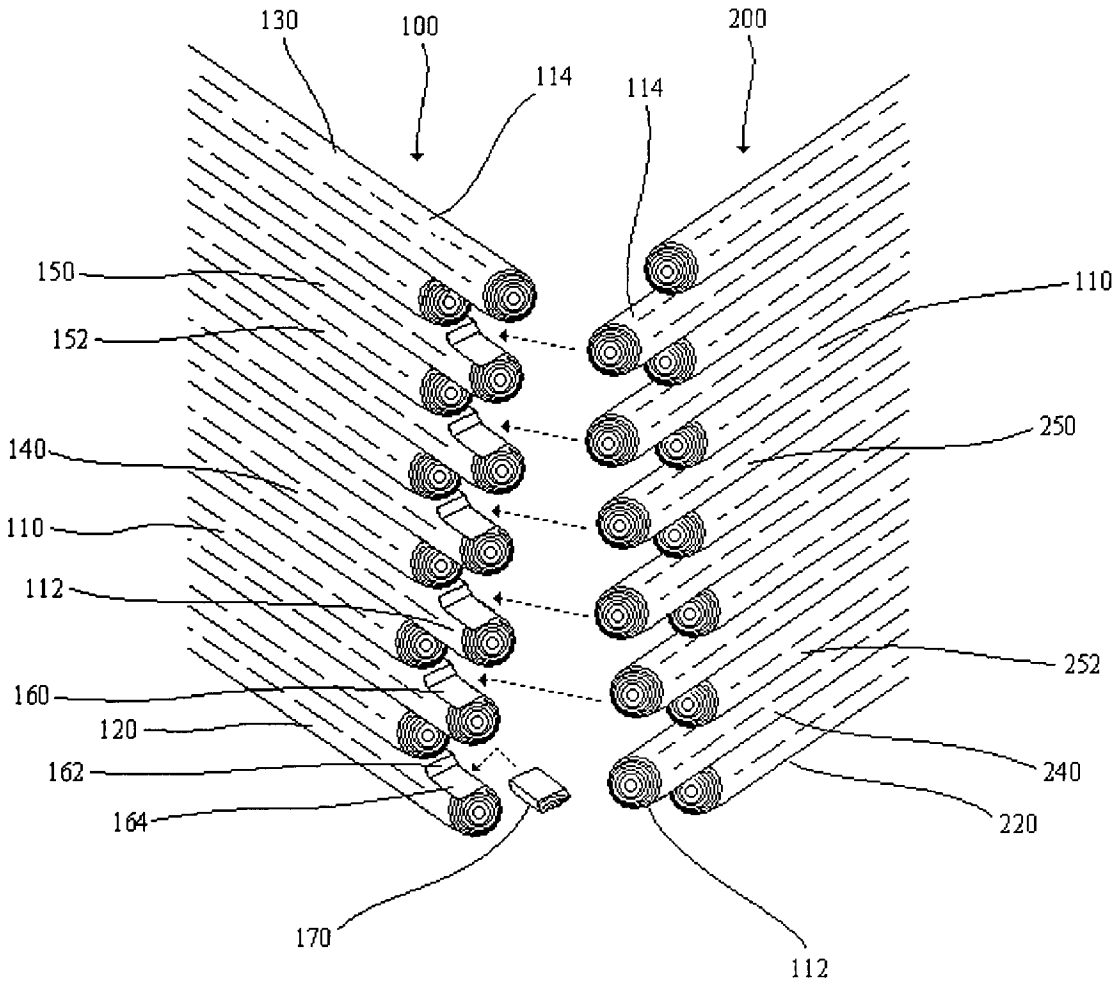
FIG. 1 is an exploded view of the first wall and the second wall of the present invention, with a plurality of dotted lines indicating how the first and second walls are to be placed together, and further disclosing the notches of the first protruding log members and one plug, with a single dotted line indicating the how the plug is to be positioned within a notch.

The log structure of the present invention comprises a first wall 100 and a second wall 200. See FIG. 1. Each wall 100,200 is defined to have a side edge, said side edge running from the top of the wall to the bottom of the wall. The side edge of the first wall 100 is suitably adapted to be joined with the side edge of the second wall 200 to form a corner assembly.

Each of the first wall 100 and the second wall 200 is constructed of at least three log members 110, said log members 110 oriented substantially horizontally and stacked substantially vertically one upon another, and affixed in place. The log members 110 may be rough hewn logs, debarked logs, shaped logs, such as "D"-shaped logs known in the art, or other configurations of logs used for construction. In the preferred embodiment each wall 100,200 comprises several more than three log members 110 each, though the walls 100,200 do not need to have the same number of log members 110.

Each log member 110 is defined to have an end 112 and a top portion 114. See FIG. 1. The top portion 114 of a log member 110 is defined as the uppermost portion of a log member 110 when the log member 110 is oriented substantially horizontally and affixed in place.

Figure 3B:
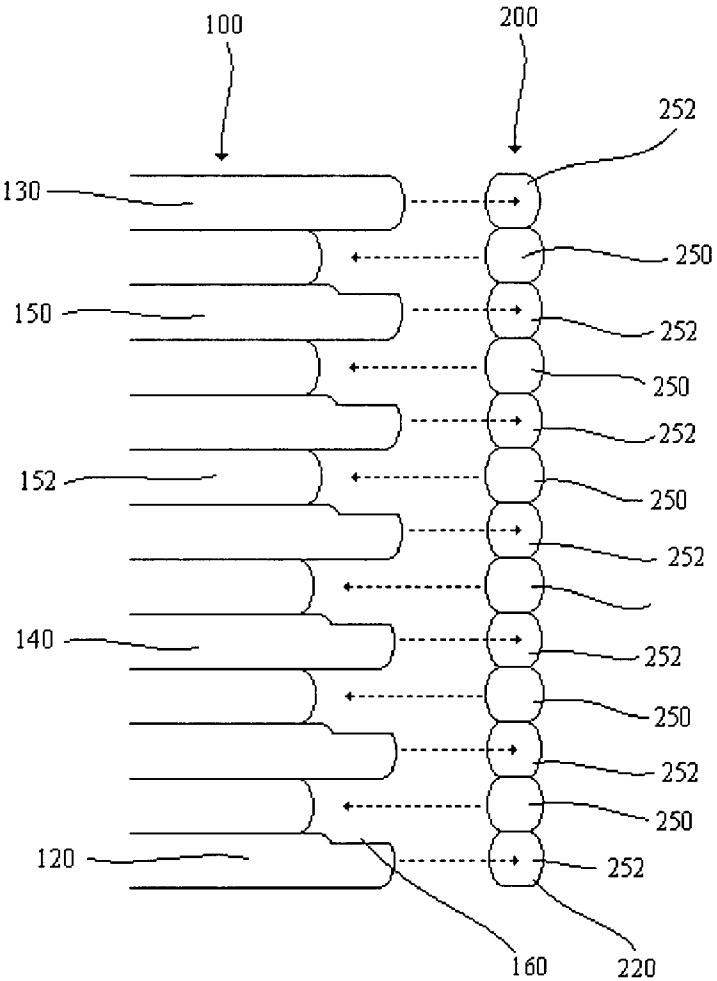
FIG. 3B is an exploded view of the first wall and an end view of the second wall, with a plurality of dotted lines indicating how the first and second walls are to be placed together, where the notches are shown with the plugs removed to disclose the gaps between pairs of the first protruding log members sufficiently large to accommodate the second protruding log members of the second wall.
Figure 3A:
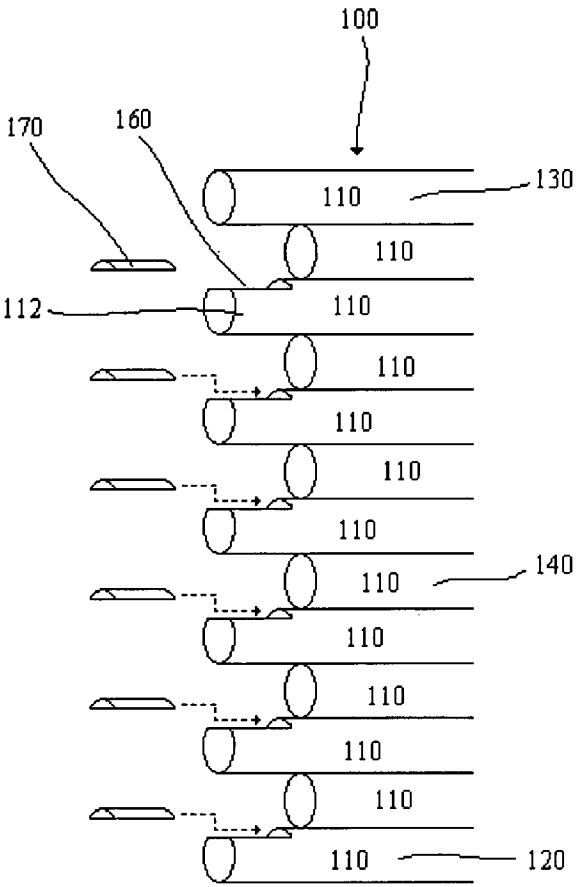
FIG. 3A is a side view of the first wall depicting the alternating arrangement of first protruding log members and first nonprotruding log members, as well as the location of the notches within the ends of the first protruding log members and how the plugs would be inserted therein.

For the first wall 100, the log members 110 are identified as base log members 120, top log members 130, and first log members 140. See FIG. 3A. The first wall 100 has one base log member 120, one top log member 130, and one or more first log members 140. The base log member 120 is the log member 110 that comprises the lowermost portion of the first wall 100 and is placed on a surface, such as the ground, a foundation, the top of another wall, or the like. One first log member 140 is placed onto the top surface of the base log member 120 and affixed to the base log member 120. The remaining first log members 140, if any, are placed onto the top surfaces of the first log members 140 already affixed to the first wall 100, and affixed thereto. The top log member 130 is placed onto the top surface of the last log member 110 to be placed and is affixed thereto, comprising the topmost portion of the first wall 100. The ends 112 of all log members 110 comprising the first wall 100 form the side edge of the first wall 100.

The log members 110 of the first wall 100 (exclusive of the top log member 130) are further identified as first protruding log members 150 and first nonprotruding log members 152. See FIG. 3A. The end 112 of each first protruding log member 150 extends laterally beyond the end 112 of each first nonprotruding log member 152. Moreover, the end 112 of each first protruding log member 150 is substantially vertically aligned with the end 112 of each other first protruding log member 150. Similarly, the end 112 of each first nonprotruding log member 152 is substantially vertically aligned with the end 112 of each other first nonprotruding log member 152. The base log member 120 is a first protruding log member 150. If there is an even number of first log members 140, half the number of the first log members 140 are first nonprotruding log members 152 and half are first protruding log members 150. If there is an odd number of first log members 140, the first log members 140 will be comprised of one more first nonprotruding log members 152 than first protruding log members 150.

The configuration of the end 112 of the top log member 130 depends on the configuration of the end 112 of the first log member 140 upon which it is placed. If the first log member 140 upon which the top log member 130 is placed is a first protruding log member 150, the end 112 of the top log member 130 is substantially vertically aligned with the ends 112 of the first nonprotruding log members 152. If the first log member 140 upon which the top log member 130 is placed is a first nonprotruding log member 152, the end 112 of the top log member 130 extends laterally beyond the ends 112 of the first nonprotruding log members 152 and is substantially vertically aligned with the ends 112 of the first protruding log members 150.

The first protruding log members 150 and the first nonprotruding log members 152 are arranged in an alternating manner. See FIG. 3A. Thus, from the base of the first wall 100, the side edge of the first wall 100 is comprised of alternating protruding and nonprotruding ends 112 of log members 110. The configuration of the top log member 130 adheres to this pattern.

Figure 4B:
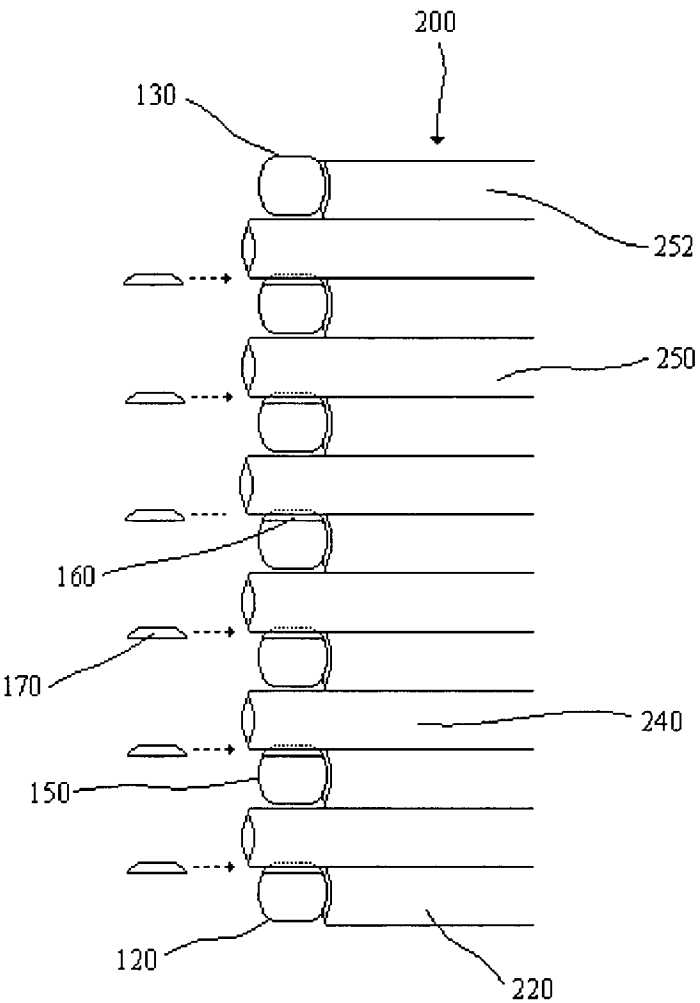
FIG. 4B is a side view of the second wall and an end view of the first wall, being a ninety degree rotation of the first and second walls depicted in FIG. 4A.

The log members 110 comprising the second wall 200 are similarly identified and configured as are those of the first wall 100. See FIG. 4B. For the second wall 200, the log members 110 are identified as second base log members 220 and second log members 240. The second wall 200 has one second base log member 220 and two or more second log members 240. The second base log member 220 is the log member 110 that comprises the lowermost portion of the second wall 200 and is placed on a surface in the same manner as the base log member 120 of the first wall 100. One second log member 240 is placed onto the top surface of the second base log member 220 and affixed to the second base log member 220. The remaining second log members 240 are placed onto the top surfaces of the second log members 240 already affixed to the second wall 200, and affixed thereto. The ends 112 of all log members 110 comprising the second wall 200 form the side edge of the second wall 200.

The log members 110 of the second wall 200 are further identified as second protruding log members 250 and second nonprotruding log members 252, analogous to the first protruding log members 150 and first nonprotruding log members 152 of the first wall 100. See FIG. 4B. The second base log member 220 is a second nonprotruding log member 252. If there are an even number of second log members 240, half the number of the second log members 240 are second protruding log members 250 and half are second nonprotruding log members 252. If there is an odd number of second log members 240, the second log members 240 will be comprised of one more second protruding log members 250 than second nonprotruding log members 252.

Figure 2:
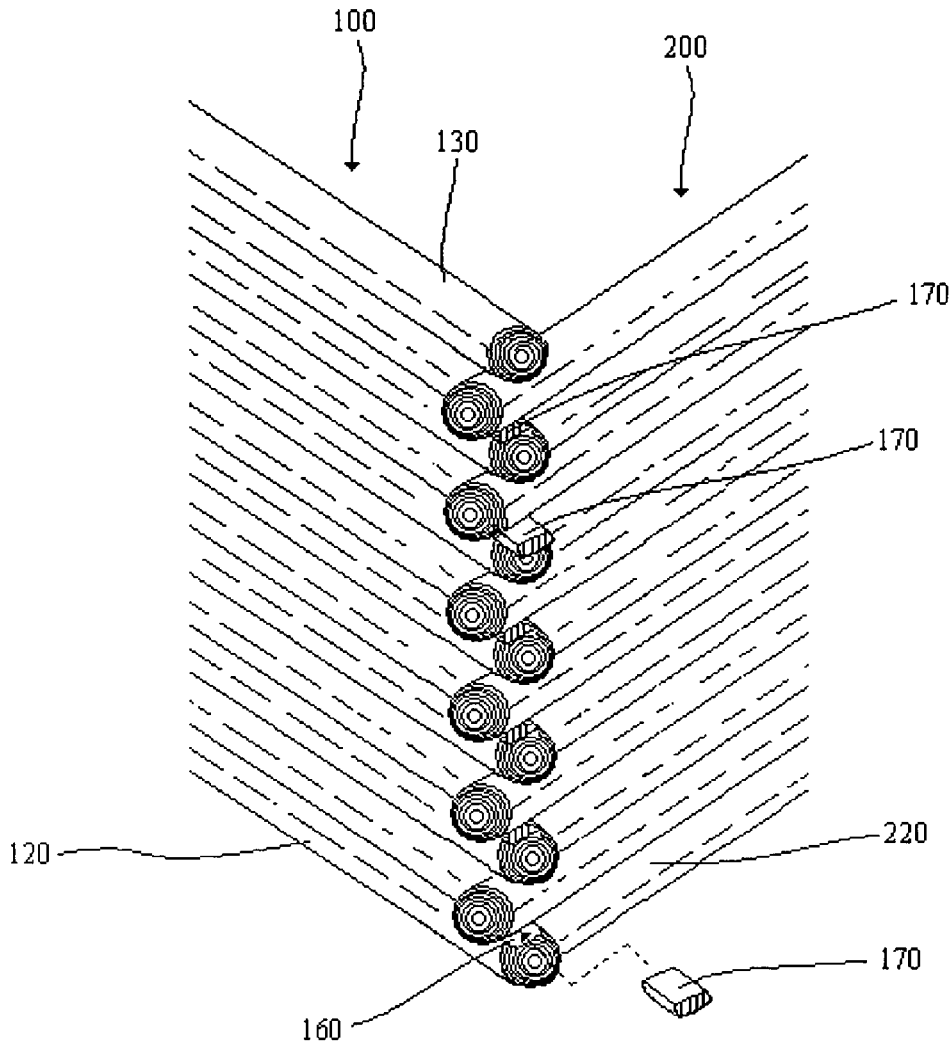
FIG. 2 is a perspective view of the first wall and the second wall depicted in FIG. 1 in their desired final orientation to each other, and further disclosing the plugs completely or partially inserted within the notches of the first protruding log members, with one plug yet to be inserted.

The second protruding log members 250 and the second nonprotruding log members 252 are arranged in an alternating manner. See FIG. 4B. Thus, from the base of the second wall 200, the side edge of the second wall 200 is comprised of nonprotruding and protruding ends 112 of log members 110. The result is that the side edge of the first wall 100 has log members 110 whose protruding ends 112 are aligned with the nonprotruding ends 112 of the corresponding log members 110 of the second wall 200 when the side edge of the first wall 100 is adjacent to the side edge of the second wall 200. See FIG. 2.

Figure 4A:
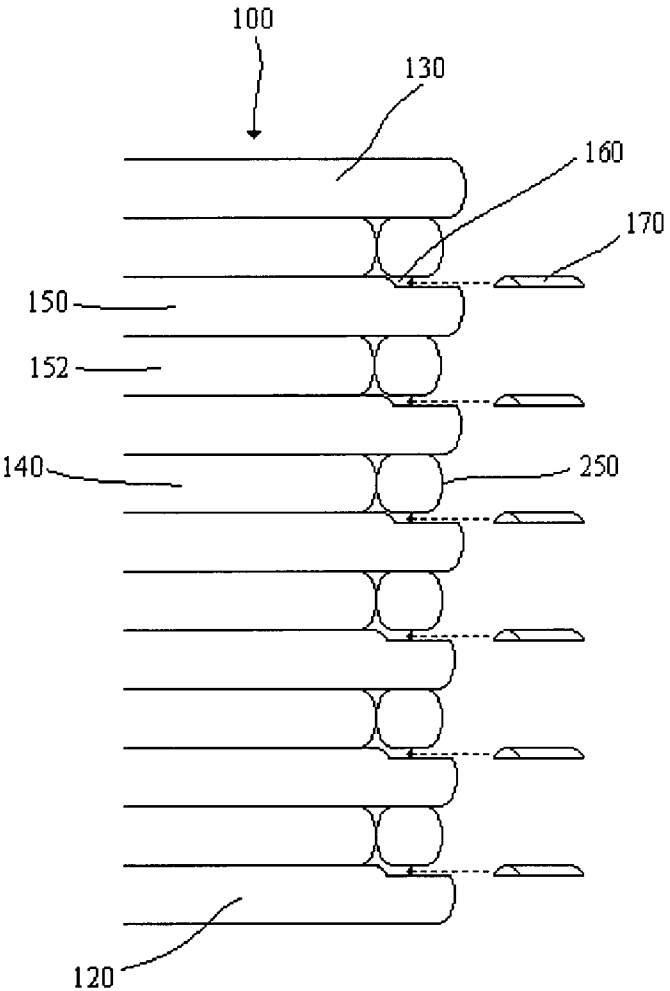
FIG. 4A is a side view of the first wall and an end view of the second wall depicted in FIG. 3B in their desired final orientation to each other, and further disclosing how the plugs may be inserted within the notches to complete the assembly.

For each first protruding log member 150 of the first wall 100, the end 112 of the first protruding log member 150 comprises a notch 160 and a plug 170. See FIGS. 1, 3A, 4A, 4B. The notch 160 is formed by the removal of a portion of the top portion 114 of the first protruding log member 150 at the end 112 of the first protruding log member 150. See FIGS. 4A, 4B. The notch 160 has a substantially vertical face 162 and a substantially horizontal base 164. See FIG. 1. The base 164 of the notch 160 extends inward from the end 112 of the first protruding log member 150, and the face 162 of the notch 160 is adjacent to the portion of the base 164 furthest from the end 112 of the first protruding log member 150.

The plug 170 of each first protruding log member 150 is a solid block corresponding in shape and dimension to the notch 160 of that first protruding log member 150. The plug 170 must be removably positionable within the notch 160. The notch 160 and plug 170 combination serves to facilitate assembly of the log structure, as will be described in more detail below. In brief, with the plugs 170 removed from the corresponding ends 112 of the first protruding log members 150, the spaces between each pair of first protruding log members 150 will be greater than the diameter of the log members 110, thus allowing easy interleaving of the ends 112 of the protruding log members 110 of the first and second walls 100,200. See FIG. 3B.

When completed, the log structure of the present invention has its first wall 100 adjacent to and connected to its second wall 200, with the first protruding log members 150 of the first wall 100 interleaved with the second protruding wall members of the second wall 200. See FIG. 2. As such, the side of the first wall 100 and the side of the second wall 200 form a corner of the log structure. For each first protruding log member 150 of the first wall 100, its corresponding plug 170 is positioned within its notch 160. The placing of the plug 170 within the notch 160 fills in the gap between the interleaved ends 112 of the protruding log members 110 of the first and second walls 100,200, resulting in a snug fit. See FIGS. 2, 4A, 4B.

In one embodiment of the present invention, for each first protruding log member 150 of the first wall 100 the corresponding plug 170 is of substantially the same shape and dimension as each other plug 170 of each other first protruding log member 150. In this configuration, the plug 170 of each first protruding log member 150 is suitably adapted to be positioned with the notch 160 of each other first protruding log member 150. This arrangement facilitates assembly of the log structure, as specific plugs 170 need not be matched with specific log members 110. Where the plugs 170 are cut directly from the ends 112 of the log members 110, this uniformity of shape and dimension represents a significant savings in time with regard to preparation of the log members 110 and assembly of the log structure.

In the preferred embodiment, for each first protruding log member 150, the width of the notch 160 and corresponding plug 170 is substantially equivalent to the horizontal cross-sectional diameter of that first protruding log member 150, and the height of the notch 160 and corresponding plug 170 is less than one half the vertical cross-sectional diameter of that first protruding log member 150. This ensures that more than half of the material comprising the end 112 of the first protruding log member 150 remains after creation of the notch 160, providing strength to the end 112 of the first protruding log member 150. Finally, the depth of the notch 160 and the corresponding plug 170 is substantially equivalent to the length of the end 112 of the first protruding log member 150 that extends laterally beyond the ends 112 of the adjacent first nonprotruding log members 152. This allows the notch 160 to accommodate the interleaved end 112 of a second protruding log member 250 snugly against the end 112 of the adjacent first nonprotruding log member 152.

Each plug 170 may be frictionally secured within a notch 160. That is, the tight tolerances of the plug 170 within the notch 160 between the interleaved protruding ends of the first and second walls 100,200 may be sufficient to retain the plug 170 securely in place. Alternately, the plug 170 may be fixedly attached within the notch 160 by one or more mechanical fasteners, such as nails or screws. In the preferred embodiment, the plugs 170 are fixedly attached within the notches 160 by an adhesive, such as wood glue or a product known as Liquid Nails®.

Figure 5B:
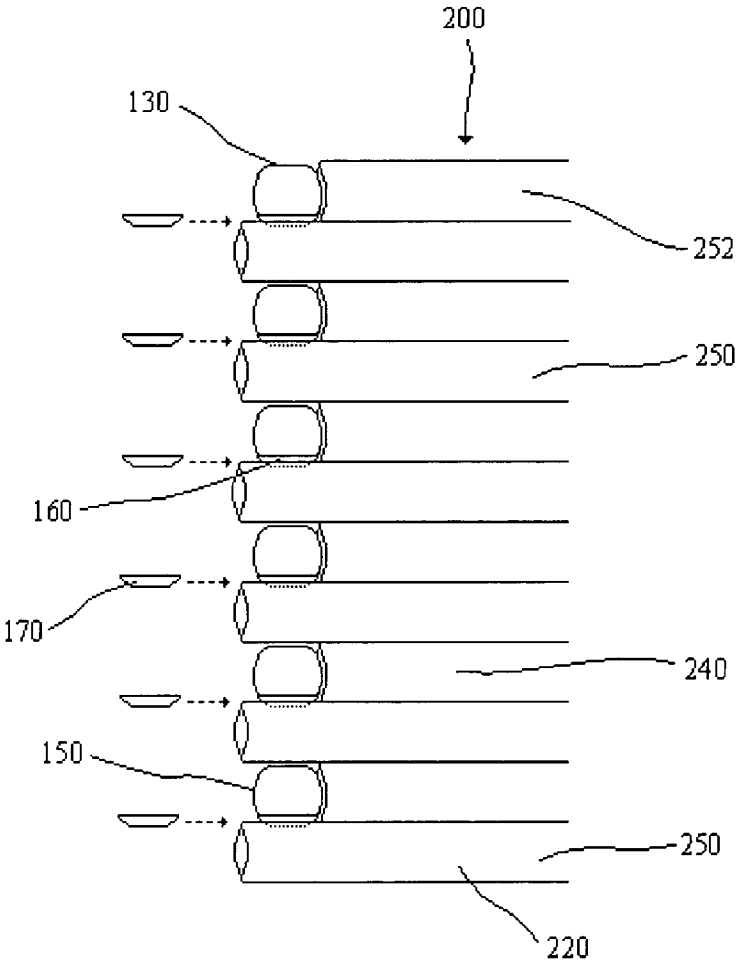
FIG. 5B is a side view of the second wall and an end view of the first wall, being a ninety degree rotation of the first and second walls depicted in FIG. 5A.
Figure 5A:
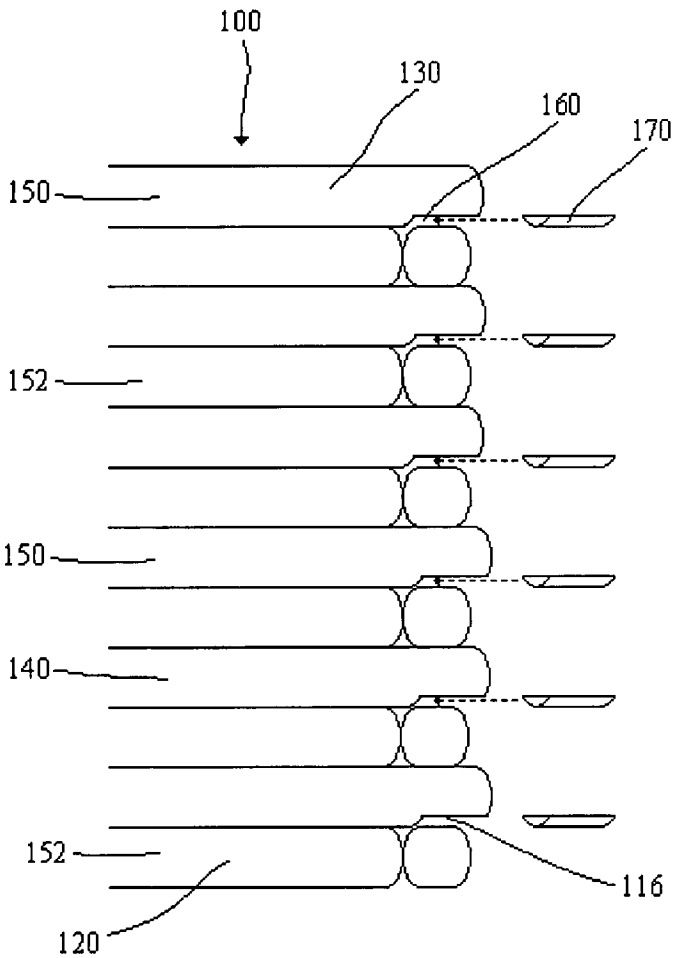
FIG. 5A is a side view of the first wall and an end view of the second wall as depicted in FIG. 4A, showing an alternate embodiment of the present invention whereby the notches formed into the bottom of the first protruding log members of the first wall.

An alternative embodiment of the log structure of the present invention contemplates a reverse alternation of the log members 110, such that the base log member 120 of the first wall 100 is a first nonprotruding log member 152, and the second base log member 220 of the second wall 200 is a second protruding log member 250. See FIG. 5A. The remaining log members 110 of each wall are arranged as protruding or nonprotruding log members 110 as before. The top log member 130 of the first wall 100 is a first protruding log member 150 if the first log member 140 upon which it is placed is a first nonprotruding log member 152, and the top log member 130 of the first wall 100 is a first nonprotruding log member 152 if the first log member 140 upon which it is placed is a first protruding log member 150.

A significant aspect of this embodiment is that for each first protruding log member 150 of the first wall 100, the notch 160 is formed from the bottom portion 116 of the log member 110 at the end 112 of the first protruding log member 150. See FIGS. 5A, 5B. The bottom portion 116 of the log member 110 is defined as the lowermost portion of the log member 110 when the log member 110 is oriented substantially horizontally and affixed in place. Other than the location of the notch 160, all other aspects of the configuration of the notch 160 and corresponding plug 170 are the same as in the prior embodiments. In this embodiment, the second base log member 220 of the second wall 200 is a second protruding log member 250, with the remaining log members 110 alternating as before.

The present invention also contemplates a method for constructing the log structure described above. The steps are as follows:

The log members 110 of the first wall 100 are prepared, by performing the following three sub-steps in any order: the base log member 120 and half the number of first log members 140 are cut to desired lengths, such that the base log member 120 and the first log members 140 have a suitable length to be utilized as first protruding log members 150; the remaining first log members 140 are cut to desired lengths, such that the remaining first log members 140 have a suitable length to be utilized as first nonprotruding log members 152; and the top log member 130 is cut to a desired length, such that said top log member 130 has a suitable length to be utilized as either a first protruding log member 150 or as a first nonprotruding log member 152, as determined by and opposite to the first log member 140 upon which it will be placed.

The next step is to prepare all first protruding log members 150 by cutting a plug 170 from the top portion 114 of the end 112 of each first protruding log member 150 to form a notch 160 and then removing the plug 170 from the notch 160. This step may be performed by automated sawmill machinery which can be configured to cut uniform plugs 170 from the ends 112 of all first protruding log members 150.

The next step is to assemble the first wall 100. This is accomplished by placing the base log member 120 in a substantially horizontal position upon a surface, such as the floor of an assembly building; placing one first nonprotruding log member 152 upon the base log member 120, with the end 112 of said base log member 120 extending laterally beyond the end of said first nonprotruding log member 152, and affixing the first nonprotruding log member 152 to the base log member 120; placing the remaining log members 110 one at a time upon the log member 110 most recently affixed in place within the first wall 100, the newly placed log member 110 being either a first protruding log member 150 or a first nonprotruding log member 152, depending on and opposite to the log member 110 most recently affixed in place within the first wall 100, such that the first protruding log members 150 and the first nonprotruding log members 152 are arranged in an alternating manner, and affixing the newly placed log member 110 to the log member 110 most recently affixed in place within the first wall 100; and placing the top log member 130 upon the log member 110 most recently affixed in place within the first wall 100 and affixing the top log member 130 to the most recently affixed log member 110. The resulting first wall 100 will have the end of each first protruding log member 150 extending laterally beyond the end of each first nonprotruding log member 152 as described above.

The next step is to prepare the log members 110 of the second wall 200, by performing the following two sub-steps in any order: the second base log member 220 and half the number of second log members 240 are cut to desired lengths, such that the second base log member 220 and the second log members 240 have a suitable length to be utilized as second nonprotruding log members 252; and the remaining second log members 240 are cut to desired lengths, such that the remaining second log members 240 have a suitable length to be utilized as second protruding log members 250.

The next step is to assemble the second wall 200. This is done in essentially the same manner as the first wall 100 is assembled. The resulting second wall 200 will have the end of each second protruding log member 250 extending laterally beyond the end of each second nonprotruding log member 252 as described above.

In one embodiment the steps of preparing and assembling the first wall 100 may be performed after the steps of preparing and assembling the second wall 200.

If the preceding steps of the method for assembling the log structure of the present invention are performed at a location remote from the construction site, the next step is to transport the first and second walls 100,200 to the construction site. Transport of the walls may be made by flat bed truck, and loading and unloading of the walls onto the truck may be facilitated by the use of cranes. Other means for transporting the walls to the construction site are also contemplated within the scope of the claims. In the preferred embodiment, the first and second walls 100,200 will be prepared and assembled at a location remote from the construction site, such as at an assembly facility, to achieve efficiencies of prefabrication and mass production without concern for environmental conditions.

The next step of the method is to position the first wall 100 as desired. The first wall 100 may be positioned by use of a crane.

The next step is to position the second wall 200 as desired, adjacent to the first wall 100. The second wall 200 may also be positioned by use of a crane. The positioning of the second wall 200 must result in the first protruding log members 150 of the first wall 100 being interleaved with the second protruding wall members of the second wall 200. This forms the corner of the log structure.

The next step is to affix the first wall 100 to the second wall 200.

The final step is to position a plug 170 within the notch 160 of each first protruding log member 150 of the first wall 100.

In one embodiment a further step is performed in which the plug 170 is fixedly attached within the notch 160 of each first protruding log member 150 by one or more mechanical fasteners. Alternatively, the plug 170 is fixedly attached by the use of an adhesive, such as wood glue or Liquid Nails®.

An alternative method for constructing the log structure of the present invention comprises the same steps described above, with the following exceptions: the base log member 120 of the wall 100 is cut to a suitable length to be utilized as a first nonprotruding log member 152, and the top log member 130 is cut to a desired length such that it has a suitable length to be utilized as either a first nonprotruding log member 152 or as a first protruding log member 150, as determined by and opposite to the first log member 140 upon which it will be placed. The notches 160 are cut from the bottom portion 116 of the end 112 of each first protruding log member 150. The second base log member 220 of the second wall 200 is cut to a suitable length to be utilized as a first protruding log member 150.

Modifications and variations can be made to the disclosed embodiments of the present invention and methods for constructing same without departing from the subject or spirit of the invention methods.

I claim:

1. A method for constructing a log structure, said log structure comprising a first wall, said first wall having a side edge and comprising three or more log members, each said log member comprising an end and a top portion, said top portion being an uppermost portion of said log member when said log member is oriented substantially horizontally, with one of the log members being a base log member, one of the log members being a top log member, and the remaining log members being first log members, with said base log member suitably adapted to be positioned substantially horizontally and placed on a surface, with one said first log member suitably adapted to be positioned substantially horizontally and placed on and affixed to said base log member, with each other said first log member and said top log member suitably adapted to be positioned substantially horizontally and placed on top of and affixed to another said first log member, with said top log member being the topmost log member of said first wall, with the ends of all said first log members, the end of said base log member, and the end of said top log member forming the side edge of said first wall, with the base log member being a first protruding log member, substantially half the number of said first log members being first protruding log members, and the remaining said first log members being first nonprotruding log members, with the end of each first protruding log member extending laterally beyond the end of each first nonprotruding log member, and the end of each first protruding log member being substantially vertically aligned with the end of each other first protruding log member, and the end of each first nonprotruding log member being substantially vertically aligned with the end of each other first nonprotruding log member, with the first protruding log members and the first nonprotruding log members arranged in an alternating manner, and for each said first protruding log member, the end of said first protruding log member comprises a notch and a plug, whereby said notch is formed by the removal of a portion of the top portion of said first protruding log member at the end of said first protruding log member, said notch having a substantially vertical face and a substantially horizontal base, and said plug being a solid block corresponding in shape and dimension to the portion of the top portion of said first protruding log member removed to form said notch, whereby said plug is removably positioned within the notch; and a second wall, said second wall having a side edge and comprising three or more log members, each said log member having an end, with one of the log members being a second base log member and the remaining log members being second log members, with said second base log member suitably adapted to be positioned substantially horizontally and placed on a surface, with one said second log member suitably adapted to be positioned substantially horizontally and placed on and affixed to said second base log member, with each other said second log member suitably adapted to be positioned substantially horizontally and placed on top of and affixed to another said second log member, with the ends of all said second log members and the end of said second base log member forming the side edge of said second wall, with the second base log member being a second nonprotruding log member, substantially half the number of said second log members being second nonprotruding log members, and the remaining said second log members being second protruding log members, with the end of each second protruding log member extending laterally beyond the end of each second nonprotruding log member, and the end of each second protruding log member being substantially vertically aligned with the end of each other second protruding log member, and the end of each second nonprotruding log member being substantially vertically aligned with the end of each other second nonprotruding log member, with the second nonprotruding log members and the second protruding log members arranged in an alternating manner;

wherein the first wall is adjacent to and connected to the second wall, with the first protruding log members of the first wall interleaved with the second protruding wall members of the second wall, such that the side of the first wall and the side of the second wall form a corner of the log structure, and for each first protruding log member the plug is positioned within the notch;

said method comprising the steps of:

A. preparing the log members of the first wall, by performing the following sub-steps in any order:

A1. cutting the base log member and substantially half the number of first log members to desired lengths, such that said base log member and said first log members have a suitable length to be utilized as first protruding log members, A2. cutting the remaining first log members to desired lengths, such that said remaining first log members have a suitable length to be utilized as first nonprotruding log members, and A3. cutting the top log member to a desired length, such that said top log member has a suitable length to be utilized as either a first protruding log member or as a first nonprotruding log member, as determined by and opposite to the first log member upon which the top log member will be placed;

B. preparing all first protruding log members by, for each said first protruding log member, cutting a plug from the top portion of the end of said first protruding log member to form a notch and then removing said plug from said notch, whereby said plug is a solid block corresponding in shape and dimension to the portion of the top portion of said first protruding log member removed to form said notch, said plug having a width, depth, and height, the width of the plug being substantially equivalent to a horizontal cross-sectional diameter of said first protruding log member, the height of the plug being less than one half a vertical cross-sectional diameter of said first protruding log member, and the depth of the plug being substantially equivalent to the length of the end of said first protruding log member that extends laterally beyond the ends of adjacent first nonprotruding log members;

C. assembling the first wall by performing the following sub-steps, in the specified order:

C1. placing the base log member in a substantially horizontal position upon a surface, C2. placing one first nonprotruding log member upon the base log member, with the end of said base log member extending laterally beyond the end of said first nonprotruding log member, and affixing said first nonprotruding log member to the base log member, C3. placing a log member upon the log member most recently affixed in place within the first wall, said newly placed log member being either a first protruding log member or a first nonprotruding log member, depending on and opposite to the log member most recently affixed in place within the first wall, such that the first protruding log members and the first nonprotruding log members are arranged in an alternating manner, and affixing said newly placed log member to the log member most recently affixed in place within the first wall, C4. repeating sub-step C3 for each remaining first log member, and C5. placing the top log member upon the log member most recently affixed in place within the first wall and affixing said top log member to said most recently affixed log member, such that the end of each first protruding log member extends laterally beyond the end of each first nonprotruding log member, the end of each first protruding log member is substantially vertically aligned with the end of each other first protruding log member, and the end of each first nonprotruding log member is substantially vertically aligned with the end of each other first nonprotruding log member;

D. preparing the log members of the second wall, by performing the following sub-steps in any order:

D1. cutting the second base log member and substantially half the number of second log members to desired lengths, such that said second base log member and said second log members have a suitable length to be utilized as second nonprotruding log members, and D2. cutting the remaining second log members to desired lengths, such that said remaining second log members have a suitable length to be utilized as second protruding log members;

E. assembling the second wall by performing the following sub-steps, in the specified order:

E1. placing the second base log member in a substantially horizontal position upon a surface, E2. placing one second protruding log member upon the second base log member, with the end of said second protruding log member extending laterally beyond the end of said second base log member, and affixing said second protruding log member to the second base log member, E3. placing a log member of the second wall upon the log member of the second wall most recently affixed in place within the second wall, said newly placed log member being either a second nonprotruding log member or a second protruding log member, depending on and opposite to the log member most recently affixed in place within the second wall, such that the second nonprotruding log members and the second protruding log members are arranged in an alternating manner, and affixing said newly placed log member to the log member most recently affixed in place within the second wall, and E4. repeating sub-step E3 for each remaining second log member, such that the end of each second nonprotruding log member extends laterally beyond the end of each second protruding log member, the end of each second nonprotruding log member is substantially vertically aligned with the end of each other second nonprotruding log member, and the end of each second protruding log member is substantially vertically aligned with the end of each other second protruding log member;

whereby steps A-C may be performed either before or after steps D-E;

F. positioning the first wall as desired;

G. positioning the second wall as desired adjacent to the first wall, such that the first protruding log members of the first wall are interleaved with the second protruding wall members of the second wall, such that the side of the first wall and the side of the second wall form a corner of the log structure;

H. affixing the first wall to the second wall; and

I. for each first protruding log member of the first wall, positioning one of said plugs cut from the one or more first protruding log members within the notch formed in said first protruding log member.

2. The method of claim 1 wherein the first wall is positioning as desired in Step F by use of a crane, and the second wall is positioning as desired in Step G by use of a crane.

3. The method of claim 1 further comprising Step J following Step I, as follows:

J. for each said first protruding log member of the first wall, fixedly attaching the plug within the notch of said first protruding log member by one or more mechanical fasteners.

4. The method of claim 1 further comprising Step J following Step I, as follows:

J. for each said first protruding log member of the first wall, fixedly attaching the plug within the notch of said first protruding log member by an adhesive.

5. A method for constructing a log structure, said log structure comprising a first wall, said first wall having a side edge and comprising three or more log members, each said log member comprising an end and a bottom portion, said bottom portion being a lowermost portion of said log member when said log member is oriented substantially horizontally, with one of the log members being a base log member, one of the log members being a top log member, and the remaining log members being first log members, with said base log member suitably adapted to be positioned substantially horizontally and placed on a surface, with one said first log member suitably adapted to be positioned substantially horizontally and placed on and affixed to said base log member, with each other said first log member and said top log member suitably adapted to be positioned substantially horizontally and placed on top of and affixed to another said first log member, with said top log member being the topmost log member of said first wall, with the ends of all said first log members, the end of said base log member, and the end of said top log member forming the side edge of said first wall, with the base log member being a first nonprotruding log member, substantially half the number of said first log members being first nonprotruding log members, and the remaining said first log members being first protruding log members, with the top log member being a first protruding log member if the log member upon which the top log member is placed is a first nonprotruding log member and the top log member being a first nonprotruding log member if the log member upon which the top log member is placed is a first protruding log member, with the end of each first protruding log member extending laterally beyond the end of each first nonprotruding log member, and the end of each first protruding log member being substantially vertically aligned with the end of each other first protruding log member, and the end of each first nonprotruding log member being substantially vertically aligned with the end of each other first nonprotruding log member, with the first nonprotruding log members and the first protruding log members arranged in an alternating manner, and for each said first protruding log member, the end of said first protruding log member comprises a notch and a plug, whereby said notch is formed by the removal of a portion of the bottom portion of said first protruding log member at the end of said first protruding log member, said notch having a substantially vertical face and a substantially horizontal base, and said plug being a solid block corresponding in shape and dimension to the portion of the bottom portion of said first protruding log member removed to form said notch, whereby said plug is removably positioned within the notch; and a second wall, said second wall having a side edge and comprising three or more log members, each said log member having an end, with one of the log members being a second base log member and the remaining log members being second log members, with said second base log member suitably adapted to be positioned substantially horizontally and placed on a surface, with one said second log member suitably adapted to be positioned substantially horizontally and placed on and affixed to said second base log member, with each other said second log member suitably adapted to be positioned substantially horizontally and placed on top of and affixed to another said second log member, with the ends of all said second log members and the end of said second base log member forming the side edge of said second wall, with the second base log member being a second protruding log member, substantially half the number of said second log members being second protruding log members, and the remaining said second log members being second nonprotruding log members, with the end of each second protruding log member extending laterally beyond the end of each second nonprotruding log member, and the end of each second protruding log member being substantially vertically aligned with the end of each other second protruding log member, and the end of each second nonprotruding log member being substantially vertically aligned with the end of each other second nonprotruding log member, with the second protruding log members and the second nonprotruding log members arranged in an alternating manner, wherein the first wall is adjacent to and connected to the second wall, with the first protruding log members of the first wall interleaved with the second protruding wall members of the second wall, such that the side of the first wall and the side of the second wall form a corner of the log structure, and for each first protruding log member the plug is positioned within the notch;

said method comprising the steps of:

A. preparing the log members of the first wall, by performing the following sub-steps in any order:

A1. cutting the base log member and substantially half the number of first log members to desired lengths, such that said base log member and said first log members have a suitable length to be utilized as first nonprotruding log members, A2. cutting the remaining first log members to desired lengths, such that said remaining first log members have a suitable length to be utilized as first protruding log members, and A3. cutting the top log member to a desired length, such that said top log member has a suitable length to be utilized as either a first nonprotruding log member or as a first protruding log member, as determined by and opposite to the first log member upon which the top log member will be placed;

B. preparing all first protruding log members by, for each said first protruding log member, cutting a plug from the bottom portion of the end of said first protruding log member to form a notch and then removing said plug from said notch, whereby said plug is a solid block corresponding in shape and dimension to the portion of the bottom portion of said first protruding log member removed to form said notch, said plug having a width, depth, and height, the width of the plug being substantially equivalent to a horizontal cross-sectional diameter of said first protruding log member, the height of the plug being less than one half a vertical cross-sectional diameter of said first protruding log member, and the depth of the plug being substantially equivalent to the length of the end of said first protruding log member that extends laterally beyond the ends of adjacent first nonprotruding log members;

C. assembling the first wall by performing the following sub-steps, in the specified order:

C1. placing the base log member in a substantially horizontal position upon a surface, C2. placing one first protruding log member upon the base log member, with the end of said first protruding log member extending laterally beyond the end of said base log member, and affixing said first protruding log member to the base log member, C3. placing a log member upon the log member most recently affixed in place within the first wall, said newly placed log member being either a first protruding log member or a first nonprotruding log member, depending on and opposite to the log member most recently affixed in place within the first wall, such that the first protruding log members and the first nonprotruding log members are arranged in an alternating manner, and affixing said newly placed log member to the log member most recently affixed in place within the first wall, C4. repeating sub-step C3 for each remaining first log member, and C5. placing the top log member upon the log member most recently affixed in place within the first wall and affixing said top log member to said most recently affixed log member, such that the end of each first protruding log member extends laterally beyond the end of each first nonprotruding log member, the end of each first protruding log member is substantially vertically aligned with the end of each other first protruding log member, and the end of each first nonprotruding log member is substantially vertically aligned with the end of each other first nonprotruding log member;

D. preparing the log members of the second wall, by performing the following sub-steps in any order:

D1. cutting the second base log member and substantially half the number of second log members to desired lengths, such that said second base log member and said second log members have a suitable length to be utilized as second protruding log members, and D2. cutting the remaining second log members to desired lengths, such that said remaining second log members have a suitable length to be utilized as second nonprotruding log members;

E. assembling the second wall by performing the following sub-steps, in the specified order:

E1. placing the second base log member in a substantially horizontal position upon a surface, E2. placing one second nonprotruding log member upon the second base log member, with the end of said second base log member extending laterally beyond the end of said second nonprotruding log member, and affixing said second nonprotruding log member to the second base log member, E3. placing a log member of the second wall upon the log member of the second wall most recently affixed in place within the second wall, said newly placed log member being either a second protruding log member or a second nonprotruding log member, depending on and opposite to the log member most recently affixed in place within the second wall, such that the second protruding log members and the second nonprotruding log members are arranged in an alternating manner, and affixing said newly placed log member to the log member most recently affixed in place within the second wall, and E4. repeating sub-step E3 for each remaining second log member, such that the end of each second nonprotruding log member extends laterally beyond the end of each second protruding log member, the end of each second nonprotruding log member is substantially vertically aligned with the end of each other second nonprotruding log member, and the end of each second protruding log member is substantially vertically aligned with the end of each other second protruding log member;

whereby steps A-C may be performed either before or after steps D-L;

F. positioning the first wall as desired;

G. positioning the second wall as desired adjacent to the first wall, such that the first protruding log members of the first wall are interleaved with the second protruding wall members of the second wall, such that the side of the first wall and the side of the second wall form a corner of the log structure;

H. affixing the first wall to the second wall; and

I. for each first protruding log member of the first wall, positioning one of said plugs cut from the one or more first protruding log members within the notch formed in said first protruding log member.

6. The method of claim 5 wherein the first wall is positioning as desired in Step F by use of a crane, and the second wall is positioning as desired in Step G by use of a crane.

7. The method of claim 5 further comprising Step J following Step I, as follows:

J. for each said first protruding log member of the first wall, fixedly attaching the plug within the notch of said first protruding log member by one or more mechanical fasteners.

8. The method of claim 5 further comprising Step J following Step I, as follows:

J. for each said first protruding log member of the first wall, fixedly attaching the plug within the notch of said first protruding log member by an adhesive.

* * * * *